US005489128A

United States Patent [19]

Florian

[11] Patent Number: 5,489,128

[45] Date of Patent: Feb. 6, 1996

[54] LOCKSET HAVING ADJUSTABLE BACKSET

[76] Inventor: David W. Florian, 35 Copper Ridge, Southington, Conn. 06489

[21] Appl. No.: 261,991

[22] Filed: Jun. 17, 1994

[51] Int. Cl.[6] ..... E05C 1/00

[52] U.S. Cl. ..... 292/1.5; 292/337; 292/DIG. 60

[58] Field of Search ..... 292/1.5, 169, 337, 292/DIG. 60; 70/461

[56] References Cited

U.S. PATENT DOCUMENTS

| | | | |
|---|---|---|---|
| 294,560 | 3/1884 | Woodrich | 70/449 |
| 1,724,630 | 8/1929 | Wilson | 292/169 |
| 2,822,202 | 2/1958 | Welch | 292/337 X |
| 2,905,495 | 9/1959 | Adamson . | |
| 2,937,897 | 5/1960 | Soderberg | 292/337 X |
| 4,468,059 | 8/1984 | Nelson et al. . | |
| 4,615,549 | 10/1986 | Couture . | |
| 4,639,025 | 1/1987 | Fann et al. . | |
| 4,691,951 | 9/1987 | Fildan | 292/DIG. 60 X |
| 4,759,576 | 7/1988 | Ching . | |
| 4,767,140 | 8/1988 | Lin . | |
| 4,834,432 | 5/1989 | Smallegan et al. . | |
| 4,921,290 | 5/1990 | Dietrich . | |
| 4,950,008 | 8/1990 | Fang . | |
| 4,976,122 | 12/1990 | Doolan et al. . | |
| 4,979,768 | 12/1990 | Marotto et al. . | |
| 5,094,488 | 3/1992 | Boadwine et al. . | |
| 5,152,161 | 10/1992 | Lee | 70/461 |
| 5,152,558 | 10/1992 | Smith et al. . | |
| 5,364,138 | 11/1994 | Dietrich et al. | 292/1.5 |

*Primary Examiner*—Steven N. Meyers
*Assistant Examiner*—Monick E. Millner
*Attorney, Agent, or Firm*—Bachman & LaPointe

[57] ABSTRACT

A latch assembly having an adjustable backset has a housing and a bolt having a length and being slidably disposed within said housing, said bolt assembly comprising a latch member, a draw bar, and a connector for connecting said latch member and said draw bar and for adjusting said latch member relative to said draw bar so as to adjust said length of said bolt assembly over a range including an extended length, a shortened length, and any length therebetween. The latch assembly may be used for any standard or non-standard backset within said range.

15 Claims, 3 Drawing Sheets

LOCKSET HAVING ADJUSTABLE BACKSET

BACKGROUND OF THE INVENTION

The invention relates to a latch assembly having an adjustable backset which is adjustable over a range which includes and preferably extends beyond conventional 2¾ and 2⅜ inch backsets, and any position therebetween.

In the lock industry, the backset is the horizontal distance from the edge of a door to the center of the hole or cavity for receiving the knob or other latch or lock structure of the door. Two standard backsets are widely used one being 2¾ inches and the other being 2⅜ inches.

Doors are frequently pre-drilled to provide a cavity corresponding to one or the other of the aforesaid standard backsets. When a lock is to be installed or replaced in such a door, the backset must correspond to the positioning of the door cavity.

In order to avoid the necessity of stocking locksets of both backset distances, adjustable locksets have been provided which to some extent have an adjustable backset distance.

A multitude of patents exist which disclose locksets having adjustable backset assemblies wherein the bolt is adjustable to two discrete backset positions corresponding to 2⅜ and 2¾ inch backsets. These adjustable backset devices are useful in that a single device is adjustable for use with either of the standard backset distances. However, the location of the pre-drilled cavity or knob hole may frequently be slightly or even significantly out of place either intentionally or due to errors in drilling and the like. With conventional adjustable backset devices, if the cavity of a door is misdrilled or the door is provided with a non-standard backset distance, difficulty will be encountered in attempting to properly align conventional adjustable lockset devices as neither of the discrete backset distances will properly align with the cavity. Further, many conventional devices require twisting motions or disassembly in order to provide even discrete adjustment of backset position.

In light of the foregoing, a need exists for a lockset or latch assembly having an adjustable backset which is infinitely adjustable over a desired range which includes standard backset distances of 2⅜ and 2¾ inches.

It is therefore the primary object of the present invention to provide a latch assembly having an infinitely adjustable backset which is infinitely adjustable over a range including an extended and a shortened length, and any length therebetween.

It is a further object of the present invention to provide a latch assembly having a housing encompassing an adjustable length bolt assembly, wherein the housing is also adjustable to any position within a specified range so that the housing is infinitely adjustable to a desired length based upon the length of the bolt assembly.

It is a still further object of the present invention to provide a latch assembly wherein the bolt assembly is contained in a housing which housing is compatible with face plate members of both conventional rectangular and circular configuration.

Other objects and advantages will appear hereinbelow.

SUMMARY OF THE INVENTION

In accordance with the present invention, the foregoing objects and advantages are readily attained.

In accordance with the invention, a latch assembly is provided which has an adjustable backset which backset is adjustable to any position within a specified range, preferably including conventional 2⅜ and 2¾ inch backsets. The latch assembly according to the invention comprises a housing and a bolt assembly having a length and being slidably disposed within said housing, said bolt assembly comprising a latch member, a draw bar, and means for connecting said latch member and said draw bar and for adjusting said latch member relative to said draw bar so as to adjust said length of said bolt assembly over a range including an extended length, a shortened length, and any length therebetween.

In further accordance with the invention, the latch assembly further comprises a face plate member slidably mounted to said housing whereby said housing has a housing length which is adjustable over a range including an extended length, a shortened length, and any length therebetween.

BRIEF DESCRIPTION OF THE DRAWINGS

A detailed description of the preferred embodiments of the invention follows, with reference to the attached drawings wherein.

DETAILED DESCRIPTION OF THE PREFERRED EMBODIMENT

The present invention relates to a latch assembly device having an adjustable backset distance which is infinitely adjustable over a desired range. Numerous conventional locksets provide adjustable backset. However, known adjustable backset devices provide adjustment to two or three discrete positions. In accordance with the present invention, a latch assembly is provided which advantageously provides infinite adjustability of the backset over a specified range including standard backset distances of 2¾ and 2⅜ inches, and any position therebetween.

Figure 1:
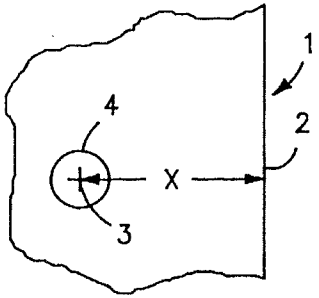
FIG. 1 illustrates the measurement of backset distance of a door.

FIG. 1 illustrates what is meant by the term "backset distance" of a door 1. Backset distance x of door 1 is measured from an edge 2 of door 1 to the center 3 of a cavity or hole 4, usually pre-drilled, for receiving the knob or latch/lock assembly to be installed in the door. Standard backset distances x are 2⅜ and 2¾ inches Edge 2 of door 1 is also shown in dashed lines in FIGS. 2 and 3 for clarity.

Figure 2:
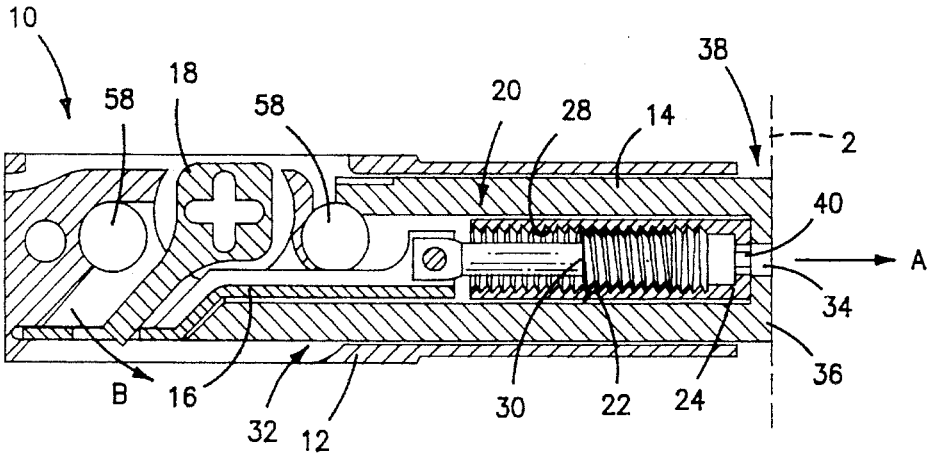
FIGS. 2 and 3 illustrate a cross section of a latch assembly in accordance with the invention with the bolt assembly adjusted to a shortened length and an extended length respectively.
Figure 2A:
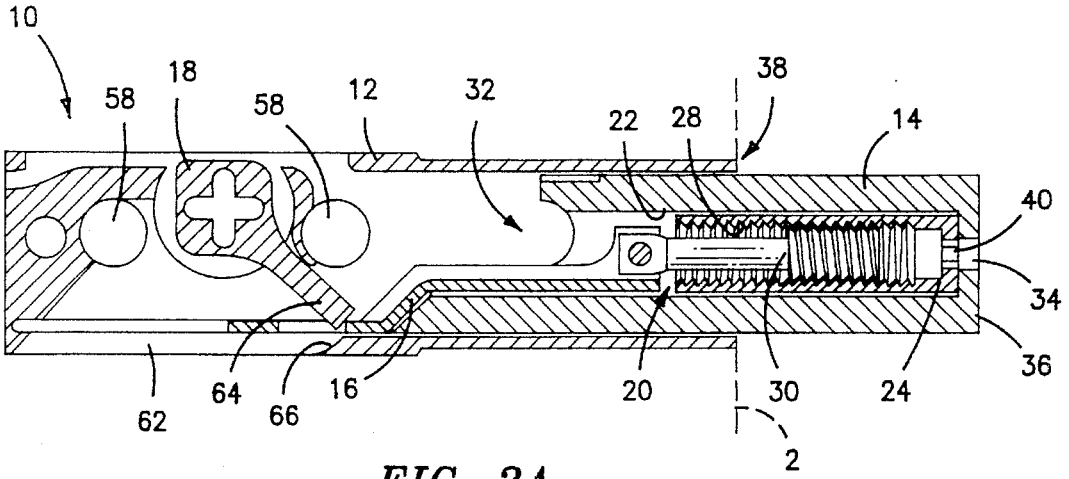
FIG. 2A illustrates the latch assembly of FIG. 2 in a locked position.
Figure 3:
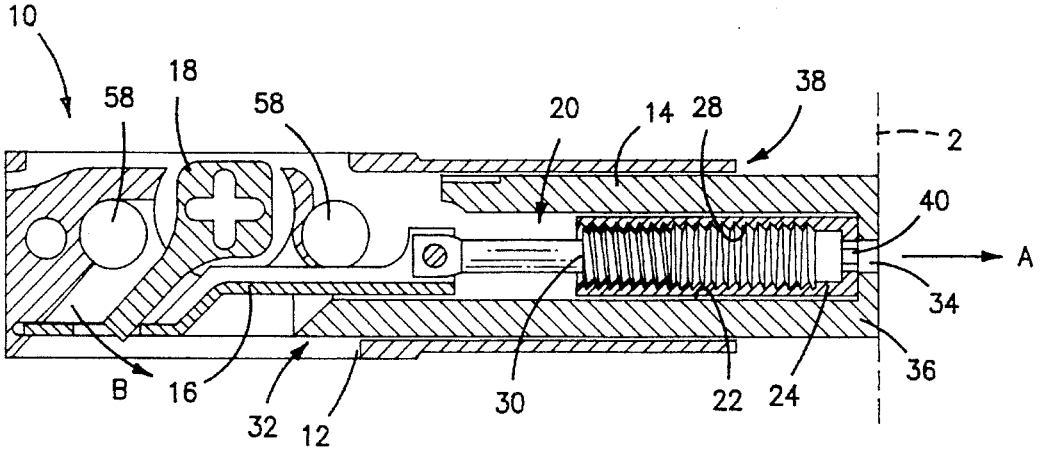

FIGS. 2 and 3 illustrate a cross section of a preferred embodiment of a latch assembly in accordance with the invention, wherein the latch assembly is generally referred to as reference numeral 10. Latch assembly 10 is shown in FIG. 2 in a shortened position or length having a shortened backset distance. FIG. 3 shows the same latch assembly 10 adjusted according to the invention to an extended length. Both FIGS. 2 and 3 show latch assembly 10 in an unlocked position. FIG. 2A illustrates the shortened backset distance latch assembly 10 of FIG. 2 in a locked position.

Latch assembly 10 in accordance with the invention includes a housing 12, a latch member 14 slidably disposed within housing 12, a draw bar member 16 connected to latch member 14, and a conventional actuating member 18 for translating rotation of a knob or other structure (not shown) to draw bar 16 for extending latch 14 out of housing 12 in the direction of arrow A (FIGS. 2 and 3) to a locked position (FIG. 2A), and for withdrawing latch 14 within housing 12 to an unlocked position. The rotation or pivot of actuating member 18 which leads to extension of latch member 14 into the locked position is shown by arrow B in FIGS. 2 and 3.

In accordance with the invention, an adjustable connector assembly 20 is provided for adjustably connecting latch 14 to draw bar 16 so that the length of the bolt assembly 32, namely latch 14 and draw bar 16, is adjustable over a specified range which preferably includes settings corresponding to a standard 2⅜ inch backset (FIG. 2), a standard 2¾ inch backset (FIG. 3) and any length therebetween. Infinite adjustability over the desired range is preferably provided with a threaded connection as will be further described below. The threaded connection is preferably a multi-turn helical thread assembly having relatively small advance per rotation so that small increments of adjustment are readily available.

Such a threaded connector assembly 20 is also desirable because operation of the latch assembly 10 is possible at any position within the desired range to which connector assembly 20 is rotated. In other words, and advantageously, latch assembly 10 of the present invention is not "disabled" as are conventional devices when such devices are between the conventional finite settings to which they are adjustable. This is due to the fact that draw bar 16 and latch 14 remain fixed lengthwise relative to each other as they are adjusted to any length within the aforesaid range.

A further advantage of the threaded connection is that latch assembly 10 remains operable even when the length of bolt assembly 32 is shortened so that latch 14 is withdrawn into housing 12. This may be useful if the door jam into which latch 14 is locked does not have the conventional one inch in depth available. A conventional lock could not be "dead locked" in such a case because it could not be fully extended into the "dead locked" position of FIG. 2A. Rather, only a partial extension would be possible, and a partially extended latch 14 or bolt may be forced back by an intruder.

With the latch assembly of the present invention, such a situation may be overcome by withdrawing latch 14 into housing 12 a sufficient distance in the unlocked position so that, when latch 14 is to be locked, the full extension of latch 14 out of housing 12 is reduced to an amount which can be received by the door jam.

Preferably, adjustable connector assembly 20 provides adjustment of the length of bolt assembly 32 to backset distances of greater than or equal to 2¾ inches as well as less than or equal to 2⅜ inches. In this manner, latch assembly 10 may be used in situations where the backset may have been drilled, mistakenly or otherwise, at positions greater than an extended length of 2¾ inches or less than a shortened length of 2⅜ inches.

Figure 4:
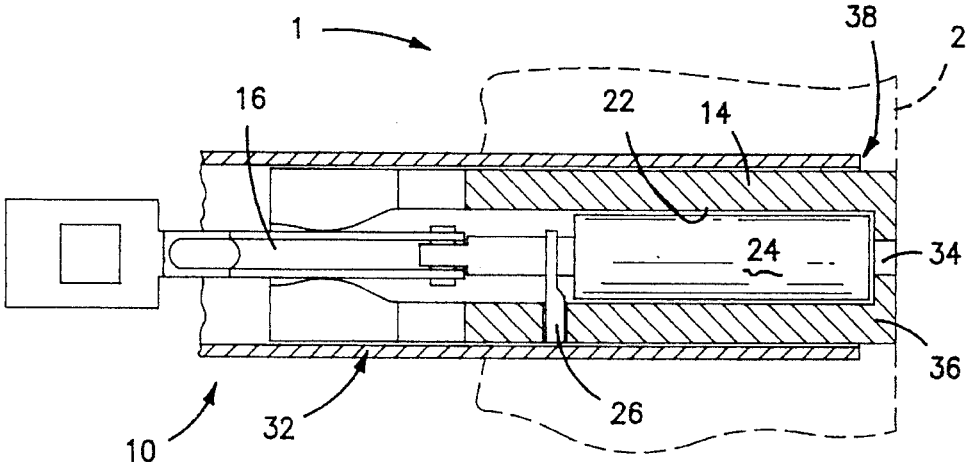
FIG. 4 illustrates a cross section perpendicular to that of FIGS. 2 and 3, further illustrating the features of a latch assembly in accordance with the invention.

As shown in FIG. 2, a description of a threaded connector assembly in accordance with the invention follows. Latch 14 preferably comprises a substantially elongate member slidably disposed within housing 12 and slidable between a withdrawn or unlocked position as shown in FIG. 2, and an extended position wherein latch 14 is extended out of housing 12 as illustrated by arrow A in FIG. 2 to a locked position (FIG. 2A). Latch 14 preferably has a longitudinal bore 22 formed therein and rotatably accommodating a cylindrical insert 24. As best shown in FIG. 4, a stop 26 may be arranged in latch 14 so as to longitudinally hold insert 24 within bore 22 of latch 14. Stop 26 may of course be formed in any shape suitable for retaining insert 24 rotatably in position as desired. Further, it should be noted that insert 24 need not be completely cylindrical in shape, so long as it is rotatable within bore 22.

Returning to FIGS. 2 and 3, cylindrical insert 24 is also preferably provided with a bore 28 which is preferably threaded as shown to form a portion of the threaded connection of connector assembly 20. Draw bar 16 preferably has an extension 30 which is threadably engaged with bore 28 of insert 24. In this way, advantageously, rotation of insert 24 within latch 14 serves to advance or retreat extension 30 relative to insert 24, thereby adjusting the length of the bolt assembly 32 (latch 14 and draw bar 16). In accordance with the invention, such adjustment allows latch assembly 10 to be adjusted to any backset distance which may be needed to match the backset distance x (FIG. 1) of a door.

Latch 14 is preferably provided with an access or opening 34 preferably located in an end portion 36 of latch 14, so as to allow adjustment of adjustable connector 20 after latch assembly 10 is installed. Opening 34 allows access to insert 24 located within latch 14 so that insert 24 can be rotated so as to provide the desired adjustment. Opening 34 is preferably positioned in end portion 36 of latch 14 which is accessible via open end 38 of housing 12 so that adjustment of the length of bolt assembly 32 may be accomplished after installation of the lock when, of course, substantially all other portions of latch assembly 10 are within the door and thus inaccessible. Such adjustment after latch assembly 10 has been installed is greatly advantageous as compared to known devices which require twisting, disassembly, and other complicated operations for a limited adjustment.

Cylindrical insert 24 preferably has an implement receiving structure such as hex shaped aperture 40 for receiving an instrument through opening 34 to impart rotation to insert 24. Aperture 40 may suitably be slotted or grooved for receiving a screwdriver or may be hex shaped as shown for receiving an Allen wrench, or may have any other desired shape suitable for receiving an implement or tool as desired.

Insert 24 may preferably be provided out of a hardened material so as to provide additional security against sawing through latch 14 as well as the infinite adjustability in accordance with the invention.

The threaded connection between extension 30 of draw bar 16 and insert 24 positioned within latch 14 serves in accordance with the invention to provide an infinite degree of adjustability of the length of bolt assembly 32. Thus, latch assembly 10 of the present invention provides significant advantages over conventional devices which are adjustable to a finite and discrete number of settings generally corresponding only to conventional 2⅜ and 2¾ inch backsets. Advantageously, latch assembly 10 according to the invention may be used with non-standard as well as standard backset distances, and is more forgiving if the cavity is mis-drilled.

As shown in FIG. 2, extension 30 is preferably pivotally connected to draw bar 16 so as to provide proper orientation of draw bar 16 relative to actuating member 18 and cylindrical insert 24 regardless of the length to which bolt assembly 32 may be adjusted. Of course, extension 30 and draw bar 16 may alternately be provided as a single piece or element if desired. It should also be noted that, while FIGS. 2 and 3 show a threaded connection between extension 30 and insert 24 wherein the male threaded member is positioned on extension 30 and the female threaded member is positioned within bore 28, the reverse configuration would likewise be suitable and would provide the desired infinite adjustability of latch assembly 10 in accordance with the present invention. In other words, extension 30 could be provided with a bore into which insert 24, which would be at least partially threaded on the exterior surface, could be inserted.

Figure 5:
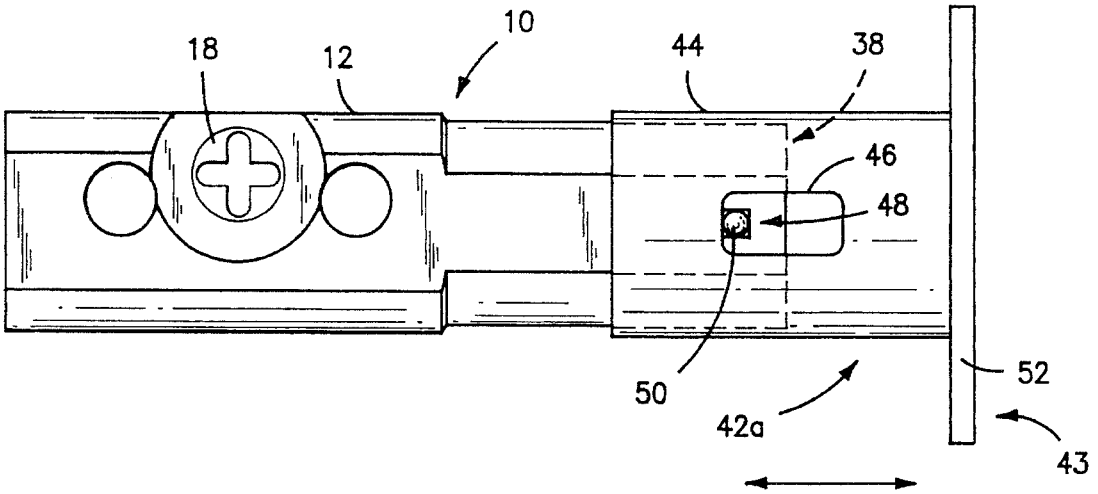
FIG. 5 illustrates a side view of a latch assembly in accordance with the invention including an adjustable face plate of rectangular configuration.
Figure 6:
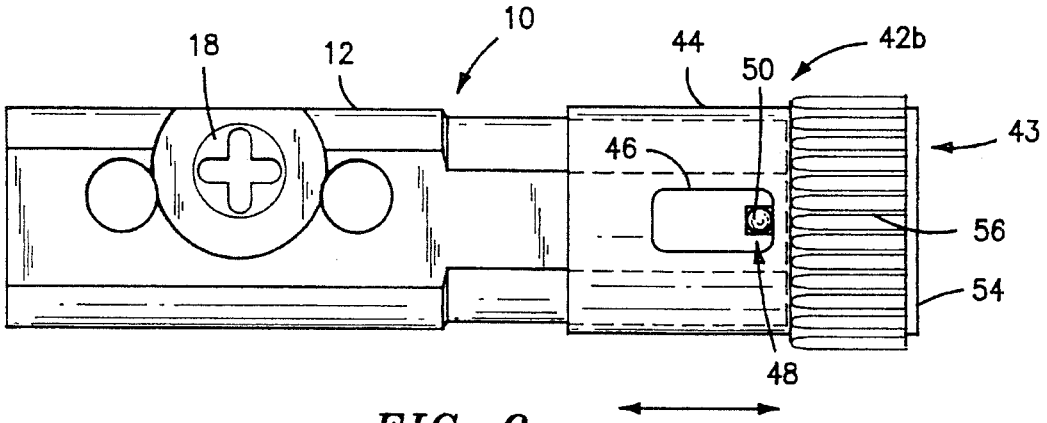
FIG. 6 illustrates a latch assembly similar to that of FIG. 5 wherein the adjustable face plate is of circular configuration.

Referring to FIGS. 5 and 6, latch assembly 10 preferably further includes a face plate member 42 which is slidably arranged over end 38 of housing 12 so that the overall length of housing 12, including face plate 42, may be adjusted along with the overall length of bolt assembly 32. FIG. 5 shows face plate 42 disposed in an extended position which would be useful with an extended backset distance, for example a 2¾ inch backset, while FIG. 6 shows face plate 42 disposed in a withdrawn position which would be useful with a shorter backset distance, for example 2⅜ inches.

Face plate member 42 preferably comprises a substantially planar portion 43 (FIG. 7) having an opening 45 for receiving end 36 of latch 14, and further includes a sleeve portion 44 rearwardly extending from planar portion 43 for slidable engagement with housing 12. As shown, sleeve portion 44 preferably has a cross section which substantially corresponds to the cross section of housing 12, so that face plate member 42 is non-rotatably, but slidably, positionable over housing 12.

In further accordance with the invention, sleeve portion 44 preferably has a slot 46 arranged longitudinally therein, for engaging with an engagement member 48 positioned on housing 12. Engagement member 48 may suitably comprise a detent ball 50 held within the wall of housing 12, and outwardly biased by latch 14 disposed within the housing 12 so that, when latch assembly 10 is assembled and installed, detent ball 50 is biased into engagement with slot 46 so as to slidably retain face plate member 42 in position on housing 12. In this way, some security against removal of face plate 42 may be provided if desired.

Figure 7:
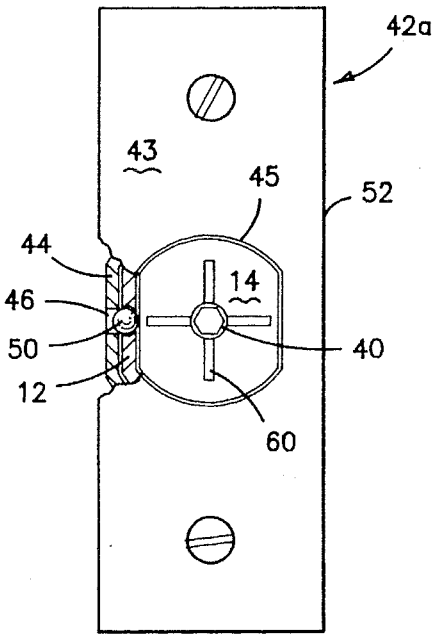
FIG. 7 illustrates an end view, partially in section, of a latch assembly in accordance with the invention.

FIG. 7 illustrates a partial cross section taken through sleeve portion 44 and housing 12 so as to show arrangement of latch 14, detent 50, and the aforementioned elements. FIG. 7 further illustrates the biasing of detent 50 by latch 14 so as to urge detent 50 into engagement with slot 46. It is noted that this feature of the invention advantageously allows face plate member 42 to be removed only when latch 14 is extended fully from housing 12 so that detent 50 is allowed to withdraw into the interior of housing 12, and out of engagement with slot 46.

It should be clear that the foregoing advantageously allows the total length of housing 12 and face plate 42 of latch assembly 10 of the present invention to be adjusted to any length between the positions illustrated in FIGS. 5 and 6.

Figure 10:
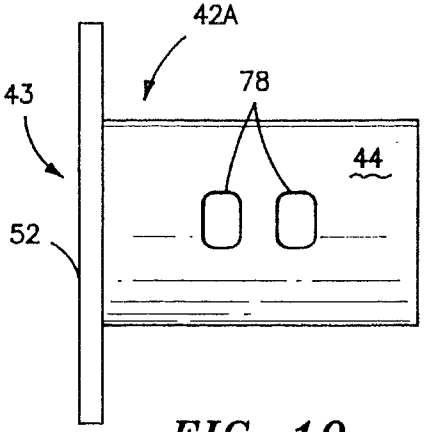
FIGS. 10 and 11 further illustrate the face plate members shown in FIGS. 5 and 6 respectively in accordance with the invention.

In further accordance with the invention, housing 12 is suitable for use with different types of face plate members 42 so as to improve the versatility of housing 12. Two widely used types of face plate members include a face plate member **42*a* having a substantially rectangular planar portion 52, as shown in FIGS. 5, 7 and 10. Face plate member 42*a* having rectangular planar portion 52 is generally useful with doors which are wooden in construction. Planar portion 52 is generally affixed to the edge portion of a door (not shown) by screws or other conventional fasteners after installation of latch assembly 10** within the bore hole or cavity of the door.

The embodiment of FIG. 6 (see also FIG. 11) includes an alternate widely used face plate member **42*b* wherein planar portion 54 is substantially circular in configuration. Circular face plate members 42*b* are typically used with metal doors, and face plate member 42*b* is generally affixed to such a door by driving or forcing the sleeve portion 44 of the face plate member 42*b* into an opening arranged in the edge of the door. Sleeve portion 44 of face plate member 42*b* may preferably be provided with longitudinal ridges 56 so as to provide a more firm engagement when face plate member 42*b*** is driven or forced into place in the door.

Housing 12 with interchangeable face plate members **42*a*, 42*b* are advantageous because housing 12 is provided which is useful with any type of face plate member 42. Conventionally, entire housings would need to be provided for each type of desired face plate fitting or member. In accordance with the invention, only the desired face plate member itself need to be provided, and such face plate members are readily interchangeable with housing 12 and releasably but securely held in place thereon by engagement member 48**.

FIG. 7 also illustrates a preferred embodiment of latch 14 wherein end portion 36 is provided with a protruding structure such as cross-hairs 60. The protruding structure is useful when the door jam must be marked for chiseling out the necessary latch receiving cavity. With the door closed, attempting to lock latch assembly 10 will drive cross hairs 60 into the surface of the door jam (not shown) and mark the surface 80 so as to provide a guide for chiseling or tooling.

Referring now to FIG. 2A, another feature of the present invention is illustrated. In FIG. 2A, actuating member 18 is pivoted and latch 14 extended to a locked position. Housing 12 generally has a slot 62 arranged to allow pivot of end 64 of member 18 between locked and unlocked positions. However, this slot 62 has also been the source of insecurity in that an intruder may attempt to unlock the lock by pulling on end 64 with an instrument such as an ice pick. In accordance with the invention, housing 12 is preferably provided with an extension 66 which partially blocks slot 62 so that end 64 is shielded and not accessible when actuating member 18 is in the locked position. This provides a latch assembly 10 in accordance with the invention having still further protection against unauthorized opening.

Figure 8:
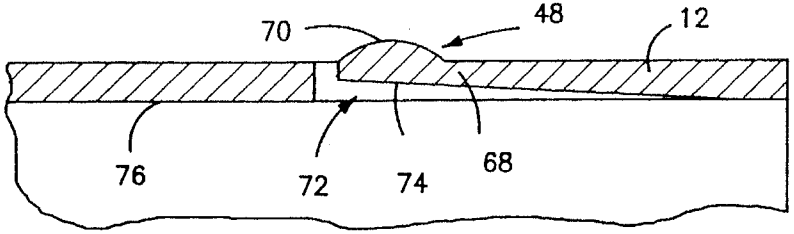
FIGS. 8 and 9 illustrate an alternate embodiment of a tab configuration for retaining a face plate member.
Figure 9:
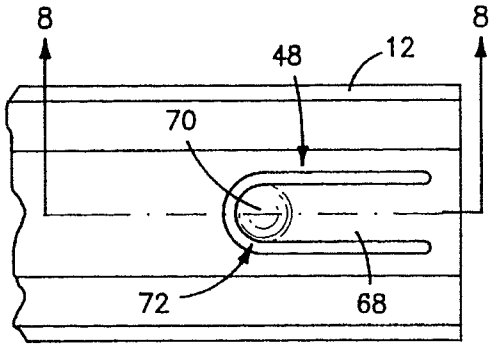

Referring now to FIGS. 8 and 9, an alternate embodiment of engagement member 48 for engaging face plate member 42 is illustrated. As shown, engagement member 48 may suitably comprise a tongue or tab 68 formed in an appropriate location on housing 12, and having a protrusion or outwardly bowed portion 70 disposed thereon, preferably at an end 72 of tab 68. Face plate member 42 may be disposed on the end of housing 12 by sliding face plate 42 over housing 12 until protrusion 70 snaps into place in slot 46 (see FIGS. 5 and 6).

Referring specifically to FIG. 8, the back surface 74 may be machined back or otherwise formed so that tab 68 may be deflected inwardly even when latch 14 (not shown in FIG. 8) is disposed within housing 12 adjacent to tab 68. Such a configuration would allow face plate member 42 to be changed at any time. If desired, back surface 74 may instead be formed substantially at the same "level" or position as the inner surface 76 of housing 12 so that tab 68 may be inwardly deflected, and face plate member 48 removed, only when latch 14 is extended or otherwise removed from behind tab 68. This embodiment is advantageous in that it provides a simple structure for engagement member 48 so as to allow interchangeability of face plate member 42*a*, 42*b* (see FIGS. 5 and 6).

Figure 11:
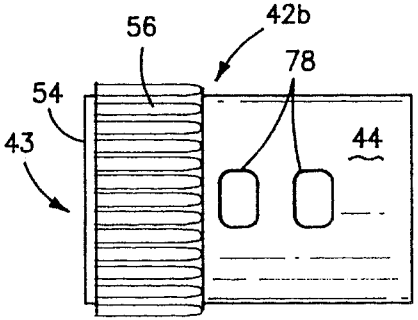

FIGS. 10 and 11 illustrate the reverse side of face plate member 42*a*, 42*b* of FIGS. 5 and 6 respectively. As shown, face plate member 42 may also be provided with two openings 78 which correspond to conventional 2⅜ and 2¾ inch backsets. If the backset of a particular door is standard, the side of face plate 42*a* or 42*b* pictured in FIGS. 10 and 11 and having two discrete openings 78 may be lined up with engagement member 48. If a non-standard length of housing 12 is needed, the slotted side of face plate 42*a*, 42*b* is aligned with engagement member 48.

Conventional locksets having adjustable backset typically require complex mechanisms to allow adjustment of both the length of the housing assembly and the latch assembly between just two discrete conventional backsets, namely 2⅜ and 2¾ inches.

In accordance with the present invention, however, such complex structures are no longer necessary as housing 12 and bolt assembly 32 may readily be installed so as to properly align with the center of the cavity of the door, while face plate member 42*a*, 42*b* is slidably adjustable to provide proper positioning relative to the edge of the door. Further, lock assembly 10 in accordance with the invention allows positioning of housing 12 and face plate member 42*a*, 42*b* to substantially any position over a desired range of adjustment. As set forth above, this range of adjustment includes backsets which are at least equal to, and preferably greater than or equal to a 2¾ inch backset, and also includes backsets which are at least equal to, and preferably less than or equal to a 2⅜ inch backset. In this way, latch assembly 10 may be used despite an irregular or non-standard backset in a particular door.

In accordance with the invention, latch assembly 10 may be installed as follows. Initially, the installer would determine whether the door requires a rectangular face plate member 42*a* or a circular face plate member 42*b*. By manipulating actuating member 18 and fully extending latch member 14 out of housing 12 and, if necessary, simultaneously adjusting the length of bolt assembly 32 to a maximum length, latch member 14 will be extended sufficiently that detent 50 is retractable within housing 12. With detent 50 so retracted, the selected face plate member 42*a* or 42*b* may be slidably disposed over end 38 of housing 12. Latch 14 is then withdrawn into the unlocked position within housing 12, and the length of bolt assembly 32 adjusted so as to shorten the length of assembly 32, so that latch 14 engages detent 50 and forces detent 50 outwardly from housing 12 so as to engage slot 46 of sleeve portion 44 of face plate member 42*a*, 42*b*. In this configuration, latch assembly 10 is now ready for installation.

Latch assembly 10 may now be positioned within the bore of the door, and engaged with a suitable knob or lock assembly through, for example, screw holes 58. Face plate member 42*a*, 42*b* is then properly orientated relative to the edge of the door, and if face plate member 42*a* is in use, suitable conventional fasteners may be deployed. At this point, housing 12 and face plate member 42 have a length corresponding to the distance, standard or otherwise, at which the cavity or hole was drilled in the door.

Adjustment of the length of bolt assembly 32 may then readily be accomplished by rotating insert 24 within latch 14, via any suitable implement, so as to adjust position of extension 30 of draw bar 16 relative to cylinder 24, thereby adjusting the length of bolt assembly 32. Adjustment should be carried out so as to align end portion 36 with the planar surface 52, 54 of face plate member 42*a*, 42*b*. At this point, latch assembly 10 is fully installed and ready for use.

In accordance with the foregoing, it should be readily apparent that latch assembly 10 is extraordinarily versatile, simple in both use and manufacture, and reliable. Further, the infinite range of adjustment of the backset which is provided by latch assembly 10 allows installation of latch assembly 10 in circumstances where conventional locks could not be installed, namely when the knob hole or cavity is drilled, incorrectly or otherwise, at a backset other than the conventional 2⅜ or 2¾ inch backset.

As with conventional adjustable locksets, a locksmith need carry only one latch assembly rather than two. However, latch assembly 10 in accordance with the present invention provides the further advantage that a locksmith will know in advance that latch assembly 10 may be used despite errors or inconsistencies in the positioning of the cavity in the door.

It is apparent that there has been provided in accordance with this invention a latch assembly having adjustable backset which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A latch assembly having an adjustable backset comprising:

a housing; and a bolt assembly having a length and being slidably disposed within said housing, said bolt assembly comprising a latch member, a draw bar, and means for connecting said latch member and said draw bar for adjusting said latch member relative to said draw bar so as to adjust said length of said bolt assembly over a range including an extended length, a shortened length, and any length therebetween, wherein said means for connecting comprises a male threaded element and a female threaded element, and wherein one of said male and female threaded elements is arranged on said draw bar, and the other of said male and female threaded elements is arranged on an insert member rotatably mounted within said latch member whereby rotation of said insert member adjusts said length of said bolt assembly without rotation of said latch member and said draw bar.

2. A latch assembly according to claim 1, wherein said extended length is greater than or equal to a 2¾ inch backset, and said shortened length is less than or equal to a 2⅜ inch backset.

3. A latch assembly according to claim 1, wherein said latch member has an exposed end, and further comprises access means at said exposed end for providing access to said insert member within said latch member, whereby said length of said bolt assembly is operably and infinitely adjustable over said range while installed in a door.

4. A latch assembly according to claim 3, wherein said insert member is a substantially cylindrical member having a first end and a second end, and wherein said other of said male and female threaded elements is arranged at said first end, and wherein said insert member further comprises implement receiving means at said second end for receiving an implement for rotating said insert member, said implement receiving means being aligned with said access means of said exposed end of said latch member.

5. A latch assembly according to claim 1, wherein said latch member has a Longitudinal bore for receiving said insert member, and further comprising retention means for rotatably retaining said insert member in said longitudinal bore.

6. A latch assembly according to claim 5, wherein said latch member has a through slot arranged in a sidewall thereof and wherein said retention means comprises a stop inserted into said slot so as to extend into said longitudinal bore whereby said insert member is rotatable and longitudinally fixed within said longitudinal bore.

7. A latch assembly according to claim 6, wherein said slot is positioned on said latch at a point where said slot is overlapped by said housing after installation of said latch assembly in a door, whereby said stop is securely held in position in said slot.

8. A latch assembly having an adjustable backset comprising:

a housing; and a bolt assembly having a length and being slidably disposed within said housing, said bolt assembly comprising a latch member, a draw bar, and means for connecting said latch member and said draw bar for adjusting said latch member relative to said draw bar so as to adjust said length of said bolt assembly over a range including an extended length, a shortened length, and any length therebetween, and further comprising means for extending said latch member from said housing to a locked position and for retracting said latch member into said housing to an unlocked position, wherein said means for extending comprises an elongate member having a first end pivotably mounted within said housing and a second end engaging said draw bar, said elongate member being pivotable between said locked and unlocked position, wherein said housing has a slot therein for accommodating pivot of said elongate member between said locked and unlocked position, and wherein said housing further includes means for shielding said extending means when said latch member is in said locked position, said shielding means comprising an extension of said housing which partially blocks said slot so as to cover said second end of said elongate member in said locked position.

9. A latch assembly having an adjustable backset comprising:

a housing; and a bolt assembly having a length and being slidably disposed within said housing, said bolt assembly comprising a latch member, a draw bar, and means for connecting said latch member and said draw bar for adjusting said latch member relative to said draw bar so as to adjust said length of said bolt assembly over a range including an extended length, a shortened length, and any length therebetween, and further comprising a face place member slidably mounted to said housing whereby said housing has a housing length which is adjustable over a range including an extended housing length, a shortened housing length, and any housing length therebetween, wherein said face plate member comprises a planar surface having an opening corresponding to said latch member, and a sleeve portion slidably overlapping said housing, wherein said sleeve portion has a longitudinal slot arranged therein, and further comprising engaging means for engaging said face plate member on said housing, said engaging means comprising means on said housing for engaging said slot whereby said slot defines said range of adjustment of said housing length, wherein said engaging means is movable between an outwardly extending position wherein said slot is engaged and said face plate member is retained on said housing, and a withdrawn position wherein said slot of said face plate member is not engaged, and wherein said engaging member is adapted to be maintained in said outwardly extending position by said latch member when said latch member is positioned within said housing behind said engaging means.

10. A latch assembly according to claim 9, wherein said means for engaging comprises a detent mounted on said housing so as to engage said slot.

11. A latch assembly according to claim 9, wherein said face plate member has a planar surface selected from the group consisting of a rectangular planar surface and a circular planar surface.

12. A latch assembly according to claim 9, wherein said face plate member comprises a face plate kit comprising a face plate member having a rectangular planar surface and a face plate member having a circular planar surface, and wherein said housing is useable with either face plate member of said face plate kit.

13. A latch assembly according to claim 9, wherein said means for engaging comprises a deflectable tab formed on said housing and having a protrusion for engaging said slot.

14. A latch assembly having an adjustable backset, comprising:

a housing having an open end; and a bolt assembly having a length and being slidably disposed within said housing, said bolt assembly comprising a latch member having an exposed end which is exposed at said open end of said housing; a draw bar; means for adjustably connecting said latch member to said draw bar; and means for adjusting said length of said bolt assembly through said exposed end of said latch member by adjusting position of said latch member relative to said draw bar without rotation of said latch member and said draw bar whereby said length of said bolt assembly is adjustable after said latch assembly is installed in a door.

15. A latch assembly having an adjustable backset, comprising:

a housing; and a bolt assembly having a length and being slidably disposed within said housing, said bolt assembly comprising a latch member and a draw bar defining said length of said bolt assembly, and threaded means for connecting said latch member and said draw bar and for adjusting position of said latch member relative to said draw bar without rotation of said latch member and said draw bar so as to adjust said length of said bolt assembly.

* * * * *